US010608417B2

(12) United States Patent
Niessner et al.

(10) Patent No.: US 10,608,417 B2
(45) Date of Patent: Mar. 31, 2020

(54) SPARK PLUG

(71) Applicant: Federal-Mogul Ignition GmbH, Neuhaus-Schierschnitz (DE)

(72) Inventors: Werner Niessner, Steinheim (DE); Alexander Schenk, Waiblingen (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 16/002,773

(22) Filed: Jun. 7, 2018

(65) Prior Publication Data

US 2018/0287351 A1 Oct. 4, 2018

Related U.S. Application Data

(63) Continuation of application No. 15/233,668, filed on Aug. 10, 2016, now Pat. No. 10,020,640.

(30) Foreign Application Priority Data

Aug. 10, 2015 (DE) ..... 10 2015 113 175

(51) Int. Cl.

| | |
|---|---|
| ***B22F 3/23*** | (2006.01) |
| ***H01T 13/39*** | (2006.01) |
| ***H01T 13/32*** | (2006.01) |
| ***H01T 13/54*** | (2006.01) |
| ***H01T 21/02*** | (2006.01) |
| ***B22F 3/11*** | (2006.01) |
| ***B22F 3/22*** | (2006.01) |
| ***B22F 5/00*** | (2006.01) |

(52) U.S. Cl.

CPC ..... *H01T 13/39* (2013.01); *B22F 3/11* (2013.01); *B22F 3/225* (2013.01); *B22F 5/008* (2013.01); *H01T 13/32* (2013.01); *H01T 13/54* (2013.01); *H01T 21/02* (2013.01)

(58) Field of Classification Search

CPC ..... B22D 17/00; B22F 3/225
USPC ..... 313/141
See application file for complete search history.

(56) References Cited

U.S. PATENT DOCUMENTS 5,397,531 A * 3/1995 Peiris ..... B22F 3/1021 419/36
5,461,276 A 10/1995 Matsutani
6,064,144 A 5/2000 Knoll
(Continued)

FOREIGN PATENT DOCUMENTS

WO WO0111741 2/2001
WO WO2007008819 1/2007
WO WO2014177169 A1 11/2014

OTHER PUBLICATIONS

German Office Action for Application No. 102015113175.7 dated Apr. 13, 2016, 6 Pages.

*Primary Examiner* — Christopher M Raabe
(74) *Attorney, Agent, or Firm* — Reising Ethington, P.C.

(57) ABSTRACT

A spark plug having a center conductor, an insulator surrounding the center conductor, at least two electrodes forming a spark gap, and a spark plug body surrounding the insulator and having an external thread arranged at the front end of the spark plug for screwing in to an internal combustion engine. A component that is attached to the front end of the spark plug and comes into contact with fuel during operation is formed as a sintered powder injection molded part, referred to as a metal injection molded (MIM) component.

18 Claims, 3 Drawing Sheets

(56) References Cited

U.S. PATENT DOCUMENTS

Figure 1:
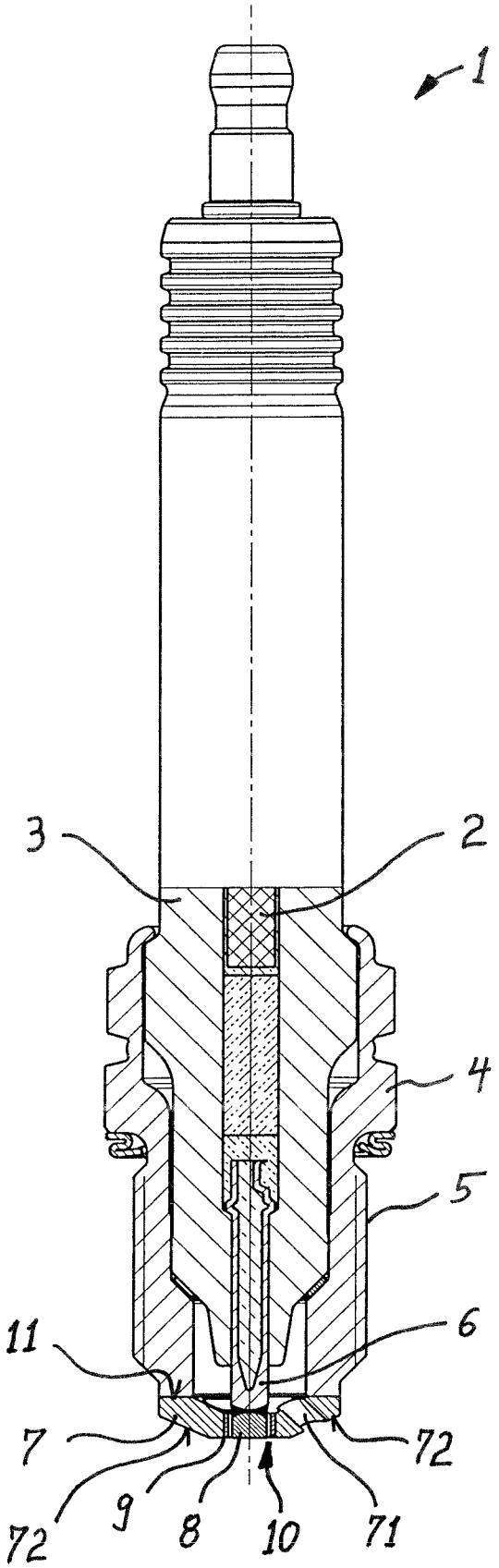

| | | | | |
|---|---|---|---|---|
| 6,080,029 | A | 6/2000 | Johnson | |
| 2011/0148274 | A1 | 6/2011 | Ernst | |
| 2012/0125279 | A1 | 5/2012 | Hampson | |
| 2012/0186723 | A1 | 7/2012 | Hattori | |
| 2013/0139784 | A1 | 6/2013 | Pierz | |
| 2013/0206122 | A1* | 8/2013 | Chiera | H01T 13/54<br>123/594 |
| 2014/0345552 | A1 | 11/2014 | Ando | |
| 2017/0054274 | A1 | 2/2017 | Sumoyama | |

* cited by examiner

SPARK PLUG

This application claims the benefit of German Application No. 10 2015 113 175.7, filed on Aug. 10, 2015, and U.S. application Ser. No. 15/233,668, filed on Aug. 10, 2016, the contents of which are hereby incorporated by reference in their entirety.

FIELD

The present invention is generally related to spark plugs, and more particularly, to spark plugs designed for internal combustion engines.

BACKGROUND

For quite a long time, spark plugs for internal combustion engines have been used in the millions in practice, and function reliably.

SUMMARY

An object of the present disclosure is to create a spark plug for which manufacturing effort is reduced.

A spark plug according to one embodiment has a center conductor, an insulator surrounding the center conductor, at least two electrodes forming a spark gap, and a spark plug body surrounding the insulator and having an external thread arranged at the front end of the spark plug for screwing in to an internal combustion engine. Various components can be attached to the front end of the spark plug that project into the motor's combustion chamber during operation and come into contact with fuel that is injected into the combustion chamber or that flows into the combustion chamber in the form of an air/fuel mixture, such as, for example, a ground electrode connected in an electrically conductive manner to the spark plug body. The spark plug can also have, at its front end, a prechamber that contains the electrodes that form the spark gap and that is a precombustion chamber in which the air/fuel mixture is ignited by the ignition spark. The flame front propagates into the main combustion chamber of the internal combustion engine through openings in the wall of the prechamber. In order to form the prechamber, a dome-shaped component can be attached to the front end of the spark plug body.

A component coming into contact with fuel during operation is formed as a sintered powder injection molded part, for which a metal powder in the desired composition is used. The manufacturing process for the powder injection molded part is also referred to as "metal injection molding," or "MIM" for short. The metal powder is mixed with a thermoplastic binder, and granulated to form a feedstock. This feedstock is injected into an injection mold, in a similar manner to plastic. Then the binder is removed from the "green part" thus formed, and the powder metal structure is sintered at high temperatures into a relatively dense component. The MIM process is known per se, but is not well known in the spark plug art to produce a spark plug component, since MIM components have a slight residual porosity after sintering which in itself gives reason to expect poorer thermal conductivity, and hence a higher component temperature, for the same shape and same dimensions of the component. As a basic principle, high temperatures of spark plug components that come into contact with fuel during operation can facilitate the occurrence of unwanted ignition of the air/fuel mixture. The present disclosure proposes using a MIM process to produce a component that comes into contact with fuel during operation for a spark plug of the initially mentioned type. A component produced in this way is called "MIM component" hereinafter. In particular, the porosity of the MIM component can be no more than 10%, in particular no more than 5%.

The MIM component is produced, in particular, from a high-temperature resistant and corrosion-resistant material that can contain nickel, for example, as the main constituent. For example, a nickel-based alloy with the material No. 2.4816 (also known by the brand name INCONEL 600) is suitable. The material can also be based on a mixture having nickel, iron, and chromium as the main components.

Embodiments are especially suitable for spark plugs that are used in stationary, gas-powered internal combustion engines. Owing to the ever increasing requirements for internal combustion engines to have low fuel consumption and low emissions, the requirements for precision have increased for spark plugs as well. Until now, the components of the spark plug that come into contact with fuel have been produced by machining processes. The semifinished products that are used for machining of the components may have internal stresses that can have the consequence that the machined part easily deforms after the material removal process due to the residual stresses contained in the material, so that its actual geometry does not match the desired geometry. For example, a ground electrode produced as a turned part may deform or bend in sections after turning so that a spark gap formed between it and a center electrode does not correspond to the desired nominal dimension. For a spark gap with, e.g., approximately 0.3 mm width a precision may be required, for example, at which the spark gap width is allowed to be no more than 0.03 mm above or below its nominal dimension. In contrast, a MIM component has the significant advantage that after forming it actually has its nominal geometry, which is not impaired by stresses contained in the material and deformations resulting therefrom. MIM components can be manufactured very easily and inexpensively without residual stresses.

On at least one surface that comes into contact with fuel during operation, the MIM component can have a low surface roughness with an average roughness $R_a$ (DIN EN ISO 4287) of no more than 3.2. In particular, the MIM component can be attached to the spark plug body without finishing of the surfaces, notably without polishing the surface. This simplifies manufacture greatly. The smooth surface of the MIM component decreases its surface area that comes into contact with the hot combustion gases. As a result, the heat input into the MIM component is reduced.

In another embodiment, the MIM component can be made of nickel or of a material with nickel as the main constituent, in particular a nickel alloy. In comparison to a material produced by fusion metallurgy, the modulus of elasticity can be reduced in the MIM component. The MIM component can have a modulus of elasticity that is at least 5% smaller, in particular at least 10% smaller, than the modulus of elasticity of a comparable component of identical geometry produced by fusion metallurgy. Thus, the comparable component has the same shape as the MIM component, but is produced in a conventional manner. The comparable component is made of a material produced by fusion metallurgy having the same composition as the MIM component's material. A reduced modulus of elasticity has advantages, especially when the MIM component is a ground electrode. Owing to the reduced modulus of elasticity, the electrode spacing can be adjusted far more easily and with greater precision by slightly bending a section of the ground electrode that is already attached to the spark plug. Consequently, the required precision for the spark gap width can be achieved more easily during spark plug manufacture than with conventional ground electrodes. Manufacturing the spark plug is simplified as a result.

The MIM component can have an annular section that rests against the spark plug body. This can promote good heat removal from the MIM component that comes into contact with fuel during operation to the spark plug body seated in the cylinder head. The annular section can be welded to the front end of the spark plug body, in particular along its entire circumference.

DRAWINGS

Figure 2:
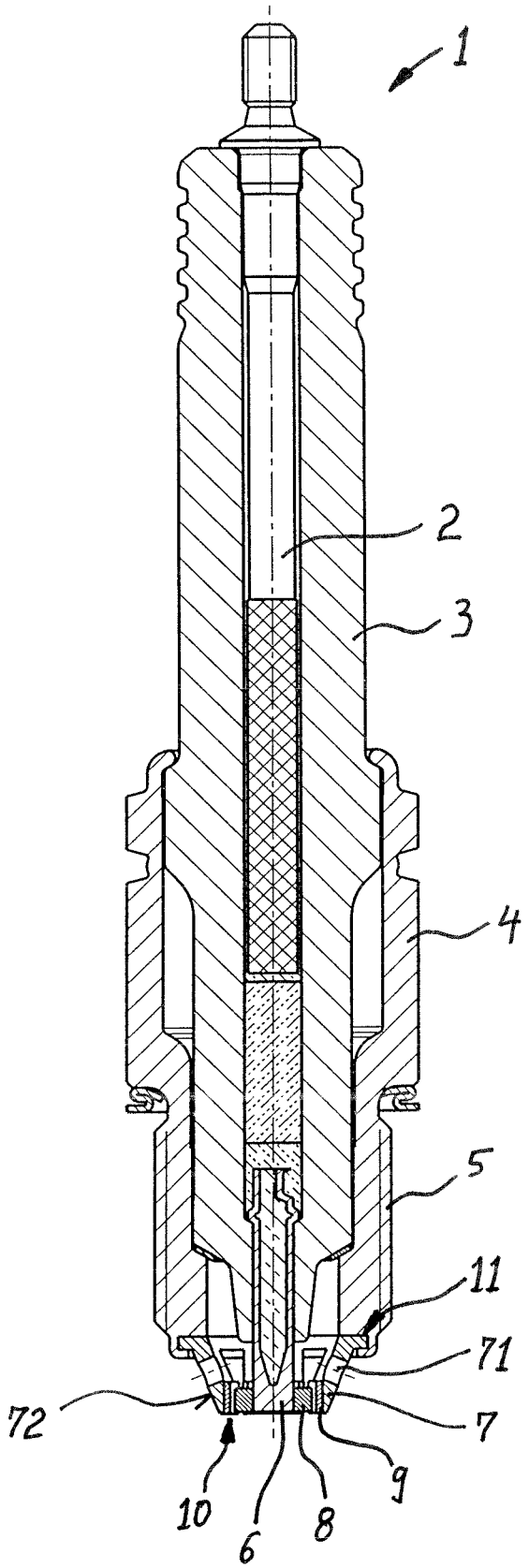
Figure 3:
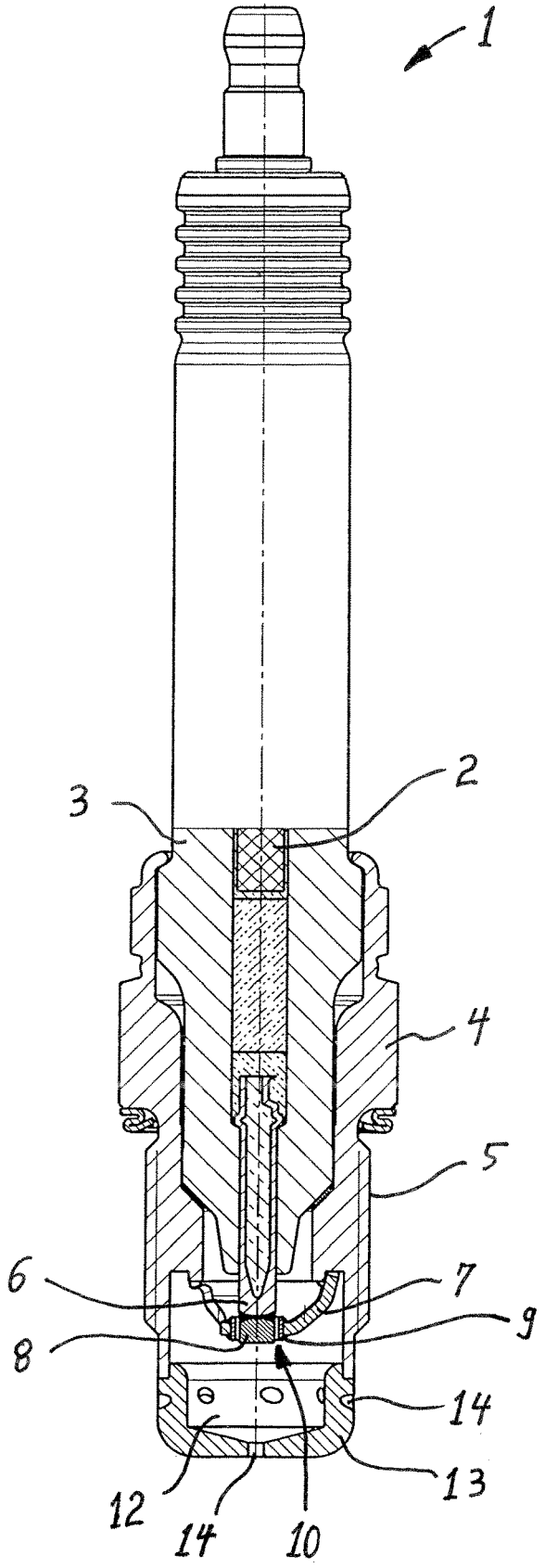

Preferred exemplary embodiments of the invention will hereinafter be described in conjunction with the appended drawings, wherein like designations denote like elements, and wherein:

FIG. 1 a partially sectional view of a spark plug according to one embodiment;

FIG. 2 a spark plug according to another embodiment, shown in longitudinal section; and FIG. 3 a partially sectional view of a third embodiment.

DESCRIPTION

FIGS. 1 to 3 each show a spark plug 1 with a center conductor 2, an insulator 3 surrounding the center conductor 2, and a spark plug body 4 surrounding the insulator 3. Arranged at the front end of the spark plug 1 is an external thread 5 on the spark plug body 4, by means of which the spark plug 1 can be screwed into an internal combustion engine—not shown—in a manner that is generally known. The spark plug 1 has at least two electrodes 6, 7, namely a center electrode 6 that is connected in an electrically conductive manner to the center conductor 2, and a ground electrode 7 connected in an electrically conductive manner to the spark plug body 4. The center electrode 6 forms, together with the ground electrode 7, a spark gap 10, which forms a spark air gap. The center electrode 6 and the ground electrode 7 each contain a precious metal reinforcement 8 or 9, respectively, which borders the spark gap 10. The reinforcements 8, 9 are made of precious metal, in particular platinum and/or iridium or an alloy thereof, and can each be welded to the electrode 6, 7.

In the embodiment from FIG. 1, the MIM component that is attached to the front end of the spark plug 1 and comes into contact with fuel during operation is the ground electrode 7, which surrounds the center electrode 6 in an annular shape and hence is designed as an annular electrode. The ground electrode 7 from FIG. 1 has an annular section 11 that rests against the spark plug body 4. The annular section 11 is welded along its entire circumference to the spark plug body 4. The ground electrode 7 from FIG. 1 also has multiple through holes 71 distributed about the circumference, and a conical section 72 at the front end.

In the embodiment of the spark plug 1 shown in FIG. 2, the ground electrode 7 is likewise implemented as a MIM component, and likewise has an annular section 11 and multiple through holes 71 and conical sections 72. The front end of the spark plug body 4 of the spark plug 1 shown in FIG. 2 is flanged over the annular section 11 in order to secure the ground electrode 7 by positive engagement. After its attachment to the spark plug body in the region of its end sections that bear the reinforcements 9 of the conical sections 72, the ground electrode 7 shown in FIG. 2 is bent slightly toward the center electrode 6, or away from it, in order to adjust the spark gap 10 to its nominal dimension with high precision. This plastic bending deformation of the ground electrode 7 is simplified by the lower modulus of elasticity of the ground electrode 7 produced as a MIM component. High precision in the spark gap width can be ensured more easily.

In the embodiment shown in FIG. 3, the spark plug 1 has, at its front end, a prechamber 12 that contains the electrodes 6, 7 and that is delimited by a cupped MIM cap component 13 which contains an annular section by which it is attached to the front end of the spark plug body 4. The MIM component 13 has multiple through holes 14.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

| List of Reference Numerals | |
|---|---|
| 1 | Spark plug |
| 2 | Center conductor |
| 3 | Insulator |
| 4 | Spark plug body |
| 5 | External thread |
| 6 | Center electrode |
| 7 | Ground electrode |
| 8 | Reinforcement |
| 9 | Reinforcement |
| 10 | Spark gap |
| 11 | Annular section |
| 12 | Prechamber |
| 13 | MIM component |
| 14 | Through holes |
| 71 | Through holes |
| 72 | Conical sections |

The invention claimed is:

1. A method of manufacturing a spark plug component, comprising the steps of:

mixing a nickel-based metal powder with a binder material to form a feedstock material comprising the nickel-based metal powder mixed with the binder material;

providing the feedstock material to an injection mold machine;

injection molding the feedstock material in the injection mold machine to form a metal injection molded (MIM) spark plug component in the form of a green part;

removing the binder material from the green part to form the MIM spark plug component in the form of a powder metal structure;

sintering the powder metal structure to form the MIM spark plug component in the form of a MIM spark plug cap or MIM spark plug ground electrode; and attaching the MIM spark plug component to a spark plug body without polishing a surface of the spark plug component, wherein during the attaching step, an unpolished surface of the MIM spark plug component is attached to the spark plug body.

2. The method of claim 1, further comprising the step of welding an annular section of the MIM spark plug component to a front end of a spark plug body.

3. The method of claim 2, wherein the annular section of the MIM spark plug component is welded along an entire circumference to the front end of the spark plug body.

4. The method of claim 1, wherein the nickel-based metal powder includes a nickel-based alloy having nickel, iron, and chromium, with nickel as the main constituent.

5. The method of claim 1, wherein the MIM spark plug cap or the MIM spark plug ground electrode has a modulus of elasticity that is at least 5% smaller than a modulus of elasticity of a spark plug cap or a spark plug ground electrode formed by fusion metallurgy.

6. The method of claim 5, wherein the MIM spark plug cap or the MIM spark plug ground electrode has a modulus of elasticity that is at least 10% smaller than a modulus of elasticity of a spark plug cap or a spark plug ground electrode formed by fusion metallurgy.

7. The method of claim 1, wherein the MIM spark plug component is the MIM spark plug cap, wherein the MIM spark plug cap is cupped-shaped and has multiple through holes.

8. The method of claim 7, wherein the MIM spark plug cap defines a prechamber containing a spark gap formed between a ground electrode and a center electrode.

9. The method of claim 1, wherein the MIM spark plug component is the MIM spark plug ground electrode.

10. The method of claim 9, further comprising the step of welding a precious metal reinforcement to the MIM spark plug ground electrode.

11. The method of claim 9, wherein the MIM spark plug ground electrode has an annular section and a conical section with a plurality of legs extending between the annular section and the conical section.

12. The method of claim 11, wherein at least two legs of the plurality of legs have a through hole to allow air to flow through.

13. The method of claim 11, further comprising the step of welding a precious metal reinforcement to the conical section of the MIM spark plug ground electrode.

14. The method of claim 13, wherein the precious metal reinforcement is an annular precious metal reinforcement.

15. The method of claim 1, wherein the sintering step decreases the porosity of the MIM spark plug component to 10% or less.

16. The method of claim 15, wherein the sintering step decreases the porosity of the MIM spark plug component to 5% or less.

17. A method of manufacturing a spark plug component, comprising the steps of:

mixing a nickel-based metal powder with a binder material to form a feedstock material comprising the nickel-based metal powder mixed with the binder material;

providing the feedstock material to an injection mold machine;

injection molding the feedstock material in the injection mold machine to form a metal injection molded (MIM) spark plug component in the form of a green part;

removing the binder material from the green part to form the MIM spark plug component in the form of a powder metal structure; and sintering the powder metal structure to form the MIM spark plug component in the form of a MIM spark plug cap or MIM spark plug ground electrode, wherein the MIM spark plug cap or the MIM spark plug ground electrode has a nominal geometry directly following the sintering step, wherein the nominal geometry includes at least part of an annular surface, and wherein the MIM spark plug cap or the MIM spark plug ground electrode has a modulus of elasticity that is at least 5% smaller than a modulus of elasticity of a spark plug cap or a spark plug ground electrode formed by fusion metallurgy.

18. A method of manufacturing a spark plug component, comprising the steps of:

mixing a nickel-based metal powder with a binder material to form a feedstock material comprising the nickel-based metal powder mixed with the binder material, wherein the nickel-based metal powder includes a nickel-based alloy having nickel, iron, and chromium, with nickel as the main constituent;

providing the feedstock material to an injection mold machine;

injection molding the feedstock material in the injection mold machine to form a metal injection molded (MIM) spark plug component in the form of a green part;

removing the binder material from the green part to form the MIM spark plug component in the form of a powder metal structure; and sintering the powder metal structure to form the MIM spark plug component in the form of a MIM spark plug cap or MIM spark plug ground electrode, wherein the sintering step decreases the porosity of the MIM spark plug component to 10% or less.

* * * * *